United States Patent [19]

Schaefer

[11] Patent Number: 4,575,446

[45] Date of Patent: Mar. 11, 1986

[54] PROCESS FOR PRODUCING AN INSOLE FOR SHOES

[76] Inventor: Helmut Schaefer, Winzlerstrasse 114, D-6780 Pirmasens, Fed. Rep. of Germany

[21] Appl. No.: 695,095

[22] Filed: Jan. 25, 1985

Related U.S. Application Data

[62] Division of Ser. No. 526,112, Aug. 24, 1983, Pat. No. 4,524,529.

[30] Foreign Application Priority Data

Aug. 27, 1982 [DE] Fed. Rep. of Germany ..... 3231971

[51] Int. Cl.[4] ..... A43B 23/16; B05D 1/00

[52] U.S. Cl. ..... 264/45.4; 12/146 B; 156/148; 264/279; 427/373

[58] Field of Search ..... 36/43, 44, 88, 28, 30 R, 36/119; 12/14 CB; 428/313.3, 313.5, 313.7, 315.5, 308.4, 317.9; 156/148, 78, 79; 264/45.3, 45.4, 46.4, 271.1, 279, 273, 274; 427/373

[56] References Cited

U.S. PATENT DOCUMENTS

| | | | |
|---|---|---|---|
| 2,845,640 | 8/1958 | Murrey | 12/146 B |
| 3,407,406 | 10/1968 | Wermer et al. | 36/119 |
| 3,414,988 | 12/1968 | Mattos | 36/44 |
| 3,624,191 | 11/1971 | Weight | 36/44 |
| 3,654,065 | 4/1972 | Dorosi | 36/44 |
| 3,779,855 | 12/1973 | Fonzi et al. | 428/315.5 |
| 3,791,050 | 2/1974 | Egtredt | 36/28 |
| 3,962,512 | 6/1976 | Fontana et al. | 428/315.5 |
| 4,015,041 | 3/1977 | Koschalzky et al. | 428/315.5 |
| 4,241,124 | 12/1980 | Kremer et al. | 36/43 |
| 4,257,176 | 3/1981 | Hartuns et al. | 36/44 |
| 4,464,850 | 8/1984 | Eberl et al. | 36/44 |

FOREIGN PATENT DOCUMENTS

| | | | |
|---|---|---|---|
| 241799 | 12/1964 | Austria . | |
| 366565 | 11/1979 | Austria . | |
| 33448 | 8/1981 | European Pat. Off. | 36/43 |
| 1065344 | 9/1959 | Fed. Rep. of Germany . | |
| 1952954 | 10/1969 | Fed. Rep. of Germany . | |
| 2548819 | 5/1977 | Fed. Rep. of Germany | 36/44 |
| 2728774 | 1/1979 | Fed. Rep. of Germany | 36/43 |

*Primary Examiner*—Michael Ball

*Attorney, Agent, or Firm*—Karl F. Ross; Herbert Dubno

[57] ABSTRACT

An insole for shoes, with which, after having made a connection, preferably by sewing, between the insole and the shoe upper, a body of polyurethane forming the running sole and/or the foot bed is applied to the bottom side of the insole by foaming operation, consists of a fleece substantially formed of synthetic fibres and having arranged therein a reinforcing insert approximately extending in parallel relation to the upper side of the insole. At least the upper portion of the fleece, which is adjacent the upper side of the insole on which rests the foot, is impregnated with a dispersion or emulsion containing at least 1 percent by weight of hollow microspheres, the thin shell of which consists of a vinylidene chloride copolymer and the hollow core of which contains a gas. The hollow microspheres can already be present in the dispersion or emulsion prior to the impregnating step, it is, however, also possible to provide within the dispersion or emulsion compact particles from which are, after the impregnating step, formed the hollow microspheres in situ by supplying heat.

8 Claims, 3 Drawing Figures

PROCESS FOR PRODUCING AN INSOLE FOR SHOES

This application is a division of application Ser. No. 526,112 filed Aug. 24, 1983 now U.S. Pat. No. 4,524,529.

FIELD OF INVENTION

The invention relates to a process for producing an insole for shoes whereby, after having made a connection between the insole and the upper of the shoe, a body of polyurethane and forming the running sole or the foot bed is applied by foaming operation.

BACKGROUND OF THE INVENTION

There are already known shoes of the so-called "California-type" and which are produced such that first an insole of textile or synthetic material is connected, for example by sewing, with the upper of the shoe, that subsequently the insole and the upper of the shoe are clamped on a last and introduced into a mold and that polyurethane-forming material is filled into this mold, the polyurethane-forming material becoming foamed onto the bottom side of the insole and forming the foot bed and the running sole. For preventing the polyurethane-forming material from penetrating through the insole during the foaming process and from becoming bonded to the last, it is necessary to impregnate the insole with a curable binder for closing the interstices present between the fibers, threads or the like of the insole material. However, the insole thus becomes rigid and non-yielding so that, in spite of use for the foot bed and for the running sole of an elastic, yielding polyurethane-foam, the foot is only insufficiently elastically supported. The elastic properties of this polyurethane foam are rather made ineffective for a major part by the rigid, non-yielding insole.

A further drawback of the known insoles resides in that the sewing of the shoe upper to the rigid insole strengthened by the binder can only be effected with great difficulty and frequently results in lesions of the fingers of the personnel performing this work or requires working with gloves. Finally, heat and cold insulation is insufficient with this known insole.

OBJECTS OF THE INVENTION

It is an object of the present invention to provide a process for producing an insole which is, on the one hand, impermeable to the liquid polyurethane foam and thus prevents any undesired penetration of the polyurethane-foaming material during the foaming process and which, on the other hand, has such an elasticity that the shoe provided with such an insole has outstanding pressure-elastic and tread-elastic properties and that the elasticity of the polyurethane foam is not made ineffective.

It is a further object of the present invention to provide by such a process an insole of reduced weight over the weight of known insoles and having good insulating properties.

It is a further object to give the insole by the process of the invention an extremely high resistance to breaking and to elongation, so that it is the insole which defines to a great degree the shape of the shoe and the insole is, on wearing, not altered or deformed in an undesired manner.

Furthermore, an insole shall be provided which can be sewed to the shoe upper without the danger of lesions.

SPECIFIC DESCRIPTION

Figure 1:
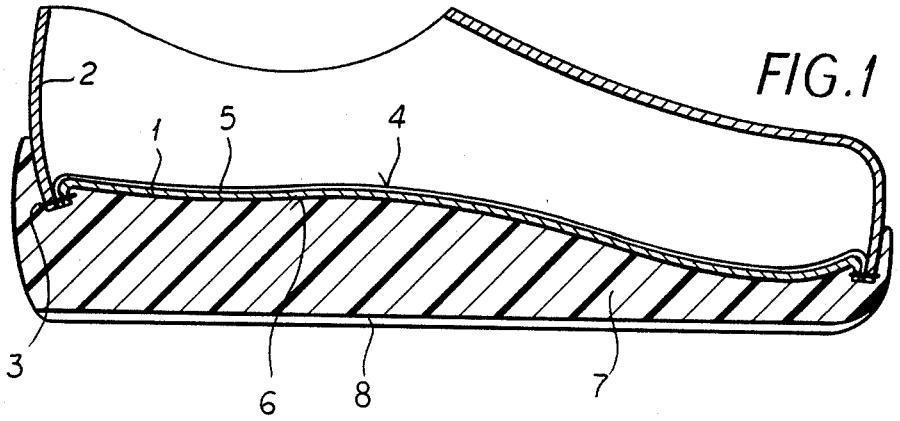
FIG. 1 shows a longitudinal section through a shoe provided with an insole according to the invention.

The shoe shown in FIG. 1 has an insole 1 connected with the shoe upper 2 at 3 by a sewing operation. The top surface 4 of the insole, on which rests the foot, can be covered by a laminar textile material 5. A polyurethane body 7 forming the foot bed and carrying at its bottom side the running sole 8 is applied by a foaming operation to the bottom side 6 of the insole 1. The running sole 8 can also be integral with the polyurethane body 7.

Figure 2:
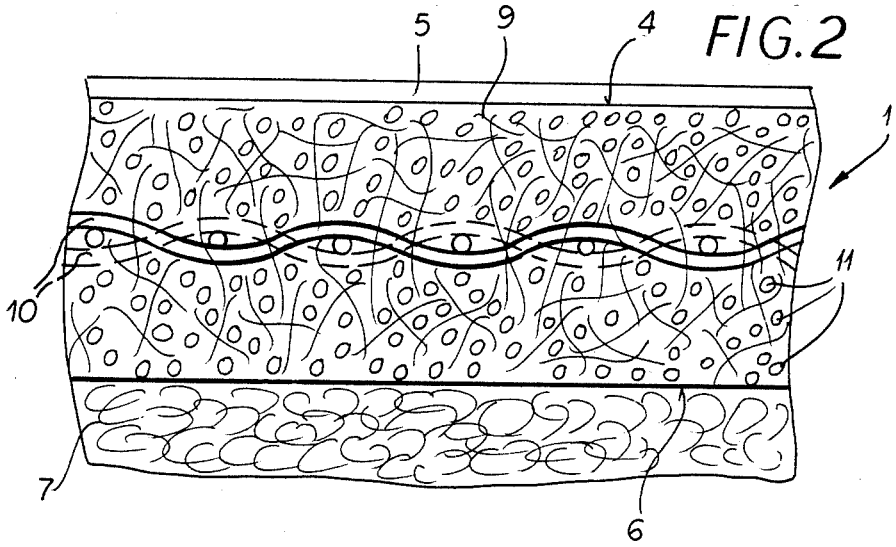
FIG. 2 shows in an enlarged scale an insole designed according to the invention and a polyurethane body applied thereto by foaming operation, and this in a section.
Figure 3:
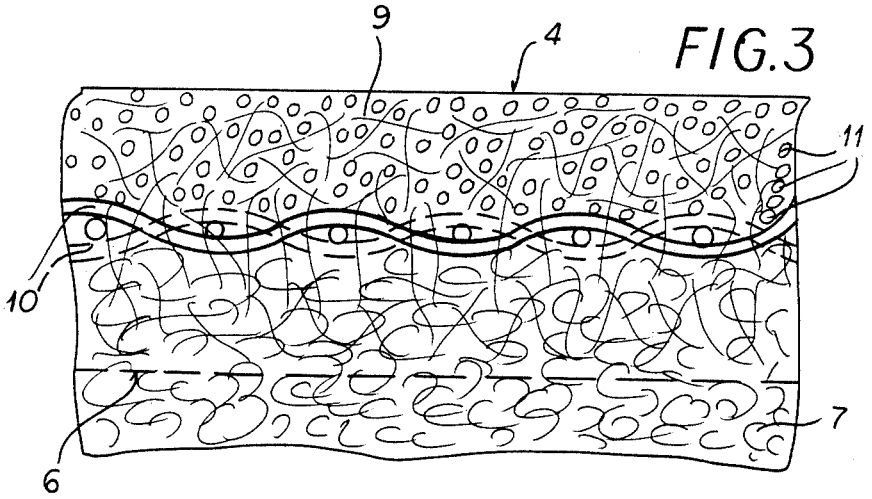
FIG. 3 shows, similar to FIG. 2, a further embodiment of the insole according to the invention.

As can be taken from FIGS. 2 and 3, the insole consists of a fleece or nonwoven fabric 9 of synthetic fibers, a reinforcing insert 10 consisting of a woven fabric, for example a fabric of woven fillets, or a knitted fabric of synthetic fibers being arranged approximately amidst the top surface 4 and the bottom surface 6. The reinforcing insert 10 conveniently consists of polypropylene fibers and had a basis weight between 72 and 165 g/m$^2$, preferably between 85 and 115. The fibers of this fleece 9 partially extend from the top surface 4 to the bottom surface 6 of the insole 1 and thus through the reinforcing insert 10.

In the embodiment according to FIG. 2, the fleece or nonwoven fabric 9 is completely impregnated by means of a dispersion or emulsion containing at least 1 percent by weight of hollow microspheres 11, the thin shell of which consists of a vinylidene chloride copolymer and the hollow core of which contains a gas. The polyurethane body 7 is applied to the bottom surface 6 of the insole 1 by foaming operation.

The inventive construction of the insole has as a result that the polyurethane-forming material is prevented from penetrating through the insole during foaming operation, the hollow microspheres acting, however, like a pneumatic spring and thus entailing pressure-elastic and tread-elastic properties for the insole. The insole is thus shock-absorbing and impact-absorbing. Furthermore, the gas enclosed within the hollow microspheres acts as a heat insulator, so that the insole according to the invention has good insulating properties. In view of the insole being provided with a reinforcing insert, the insole is tear-resistant even on stitching, so that a reliable connection between the insole 1 and the shoe upper 2 can be obtained without difficulties and without the danger of lesions by sewing operation.

Impregnation of the fleece 9 is conveniently effected by using a dispersion of synthetic plastics material, preferably a polymer dispersion. The fleece can, however, also be impregnated by using a dispersion based on natural rubber or synthetic rubber.

The hollow microspheres 11 have a diameter between 0.01 and 1 mm, noting that conveniently hollow microspheres of different diameters are used because in this case the hollow microspheres of smaller diameter enter the interstices between the hollow microspheres of greater diameter and the hollow microspheres can thus be uniformly distributed within the insole.

Hollow microspheres of the mentioned type are already known and described, for example, in Modern Plastics, August 1969, pp. 55 to 57. On account of these hollow microspheres, which assume between 6 and 36 percent of the total volume of the insole, there is also obtained a substantial weight reduction.

The embodiment according to FIG. 3 differs from the embodiment according to FIG. 2 only by the fact that only that portion of the fleece 9 which is adjacent the upper side 4 of the fleece is impregnated, by means of a dispersion containing said hollow microspheres, approximately till th reinforcing insert 10. The portion of the fleece 9, which is located below the reinforcing insert 10 and which is not impregnated, is, with this embodiment, embedded within the polyurethane body 7, which results in a still better bond between the insole and the polyurethane body 7.

When producing the insole, one can proceed such that the fleece 9 is equipped with the reinforcing insert 10 and is subsequently impregnated with a dispersion containing compact particles, containing an inflating agent, of a vinylidene chloride copolymer. Such compact particles are, for example, available under the trade mark EXPANCEL and can be supplied by the firm Kema Nord, Sundsvall (Sweden). Subsequently, the impregnated fleece 9 is heated to a temperature of more than 75° C., the hollow microspheres thereby being formed in situ. In view of this hollow microspheres being formed within the insole in situ from the compact particles containing an inflating agent, a pattern of equally distributed hollow microspheres of different diameter and snugly contacting one the other is reliably obtained.

The formation of the hollow microspheres in situ can be effected simultaneously with drying the aqueous dispersion by heat supply. Heat supply is preferably effected in a high frequency field. This provides the advantage that the fleece is uniformly heated at all areas and thus also the hollow microspheres are simultaneously formed at every place.

If formation of the hollow microspheres is effected in situ simultaneously with drying the aqueous dispersion, a dispersion of duroplastic properties, for example a dispersion consisting of melamine resins or of other aminoplasts, must be used.

Formation of the hollow microspheres from the compact particles, can, however, also be effected after having already dried the dispersion. In this case it is necessary to use a dispersion of thermoplastic properties, for example a dispersion consisting of a polyacrylate or of polyvinyl acetate.

It is convenient to strengthen the fleece 9 prior to impregnating same, for example by needling the fleece 9 at least once.

However, the procedure can also be such that the fleece 9 is impregnated with a dispersion already containing prefabricated hollow microspheres 11. This is, for example, convenient in the embodiment of FIG. 3 where only the upper area of the fleece 9 is impregnated. In this case, the dispersion containing the prefabricated hollow microspheres 11 is applied onto the fleece, for example by means of a doctor blade, and allowed to dry. After drying operation, the insole thus formed is connected with the shoe upper 2 whereupon the polyurethane-forming material is foamed onto the bottom side of the insole 1 for forming the body 7 which provides the foot bed and/or the running sole.

What is claimed is:

1. Process for producing an insole for shoes, comprising the steps of:

(a) providing a fleece, essentially consisting of synthetic fibers, with a reinforcing insert;

(b) impregnating said fleece with a dispersion or emulsion containing compact particles, containing an inflating agent, of a vinylidene chloride copolymer;

(c) heating the thus impregnated fleece to a temperature of more than 75° C., hollow microspheres being thereby formed in situ;

(d) connecting the thus formed insole with the shoe upper; and (e) applying to the bottom side of said insole, by foaming operation, a polyurethane-forming material forming the running sole and/or the foot fed of the shoe.

2. Process as claimed in claim 1, wherein the fleece is needled after having provided the reinforcing insert.

3. Process as claimed in claim 1, wherein heating is effected in a high frequency field.

4. Process for producing an isole for shoes, comprising the steps of:

(a) providing a fleece, substantially consisting of synthetic fibers, with a reinforcing insert;

(b) at least partially impregnating said fleece with a dispersion or emulsion containing hollow microspheres, the thin shell of which consists of a vinylidene chloride copolymer and the hollow core of which contains a gas;

(c) drying said dispersion or emulsion;

(d) connecting the insole thus formed with the shoe upper; and (e) applying to the bottom side of said insole, by foaming operation, a polyurethane-forming material providing the running sole and/or the foot bed of the shoe.

5. Process as claimed in claim 4, wherein only the upper porton of the fleece is impregnated approximately till the reinforcing insert with a dispersion or emulsion containing the hollow microspheres whereas the bottom portion of the fleece is foamed into the polyurethane body when applying same by the foaming operation.

6. Process as claimed in claim 4, wherein the dispersion or emulsion is applied to the fleece by means of a doctor blade.

7. Process as claimed in claim 4, wherein the fleece is needled prior to applying the dispersion or emulsion.

8. Process as claimed in claim 4, wherein drying of the dispersion or emulsion is effected in a high frequency field.

* * * * *

UNITED STATES PATENT AND TRADEMARK OFFICE

CERTIFICATE OF CORRECTION

PATENT NO. : 4,575,446

DATED : 11 March 1986

INVENTOR(S) : Helmut SCHAEFER

It is certified that error appears in the above-identified patent and that said Letters Patent is hereby corrected as shown below:

In column 4, claim 1, line 25, after "foot" correct "fed" to -- bed --.

Signed and Sealed this

*Twenty-sixth* Day of *August 1986*

[SEAL]

*Attest:*

DONALD J. QUIGG

*Attesting Officer*

*Commissioner of Patents and Trademarks*